United States Patent [19]

Taniwaki

[11] 3,944,309

[45] Mar. 16, 1976

[54] MANUALLY MOVABLE WHEELED STORAGE RACK OR THE LIKE

[75] Inventor: Genshi Taniwaki, Kumamoto, Japan

[73] Assignee: Kongo Co., Ltd., Japan

[22] Filed: Oct. 8, 1974

[21] Appl. No.: 513,086

[30] Foreign Application Priority Data

| | | |
|---|---|---|
| Nov. 30, 1973 | Japan | 48-134543 |
| Jan. 21, 1974 | Japan | 49-9492[U] |
| May 29, 1974 | Japan | 49-61448[U] |
| May 29, 1974 | Japan | 48-61447[U] |
| Mar. 21, 1968 | Japan | 43-22117[U] |

[52] U.S. Cl. ..... 312/198; 104/147 R; 105/104; 312/200

[51] Int. Cl.[2] ..... A47B 87/00

[58] Field of Search .. 312/200, 198; 104/88, 147 R; 105/86, 87, 88, 89, 101, 104, 31

[56] References Cited

UNITED STATES PATENTS

| | | | |
|---|---|---|---|
| 609,881 | 8/1898 | Flesher | 105/88 |
| 2,707,442 | 5/1955 | Ingold | 105/31 |
| 3,567,299 | 3/1971 | Lundqvist | 105/31 X |
| 3,640,595 | 2/1972 | Staller et al. | 312/200 X |
| 3,829,189 | 8/1974 | Staller | 312/198 |

*Primary Examiner*—Samuel Scott
*Assistant Examiner*—F. D. Shoemaker
*Attorney, Agent, or Firm*—Hill, Gross, Simpson, Van Santen, Steadman, Chiara & Simpson

[57] ABSTRACT

A manually movable wheeled storage rack or the like is disclosed which may be moved along a pair of rails when an operator rotates a handwheel attached to one side wall of the storage rack or the like. The storage rack or the like is further provided with a locking device so as to hold the storage rack or the like in a desired position and a safety device so that when a buffer plate of the safety device hits an operator or worker in the passage between the adjacent storage racks or the like as one of them starts to move by an accident, the safety device immediately locks the wheel, whereupon the operator or worker may be prevented from being sandwiched between the storage racks.

9 Claims, 16 Drawing Figures

MANUALLY MOVABLE WHEELED STORAGE RACK OR THE LIKE

BACKGROUND OF THE INVENTION

The present invention relates to generally wheeled storage racks, bookshelves or the like, and more particularly storage racks, bookshelves or the like which may be moved along rails when an operator rotates a handwheel.

There has been devised and demonstrated a storage rack system in which, in order to make full use of a limited storage space, a large number of wheeled storage racks or the like are arrayed on the rails laid on the floor and one of them is moved with respect to the adjacent one to provide a passage to allow a worker or librarian access to a desired storage rack or bookshelf. Each storage rack or bookshelf is provided with a handle so that one may grip it to push a storage rack or the like to a desired position. However the manual movement of a large-sized storage rack or the like becomes difficult because of its heavy weight so that the sizes of a storage rack or the like are limited. As a result, it is impossible to make the fullest possible use of the available storage space. To overcome this problem, there has been suggested the use of an electric motor for rolling heavy storage racks or the like, but the installation cost is very expensive because some parts of the driving mechanism must be disposed in the floor. The installation cost would also become prohibitive when each storage rack or the like is equipped with an individual motor.

Another important problem encountered in the storage rack system of the type described is that an operator or librarian is sandwiched between the adjacent storage racks or the like when someone moves a storage rack or the like without noticing that his colleague is in the passage between the storage racks or the like. Moreover when the rails are inclined, there is a danger that a storage rack or the like starts to roll by itself and collides against the adjacent storage rack so that the articles stored thereupon may be seriously damaged.

In view of the above, one of the objects of the present invention is to provide a wheeled storage rack or the like which may be easily moved along the rails laid on the storage floor when an operator rotates a handwheel attached to one side wall of the storage rack and drivingly coupled to the wheel through a power transmission mechanism.

Another object of the present invention is to provide a wheeled storage rack or the like of the type described further comprising a locking device for holding stationary the storage rack in a desired position and preventing it from free rolling even when the rails are inclined.

A further object of the present invention is to provide a wheeled storage rack or the like of the type described further comprising a safety device or safety locking device so that when one who is in the passage between the storage racks hits or touches a swingable buffer plate extending transversely across the whole opening of the storage rack, the storage rack may be immediately locked in position, thereby always securing a safe working space between the adjacent storage racks.

A further object of the present invention is to provide a wheeled storage rack or the like of the type described which may store therein a large number of objects and may permit the fullest possible use of a given storage space.

DESCRIPTION OF THE PREFERRED EMBODIMENTS

Figure 1:
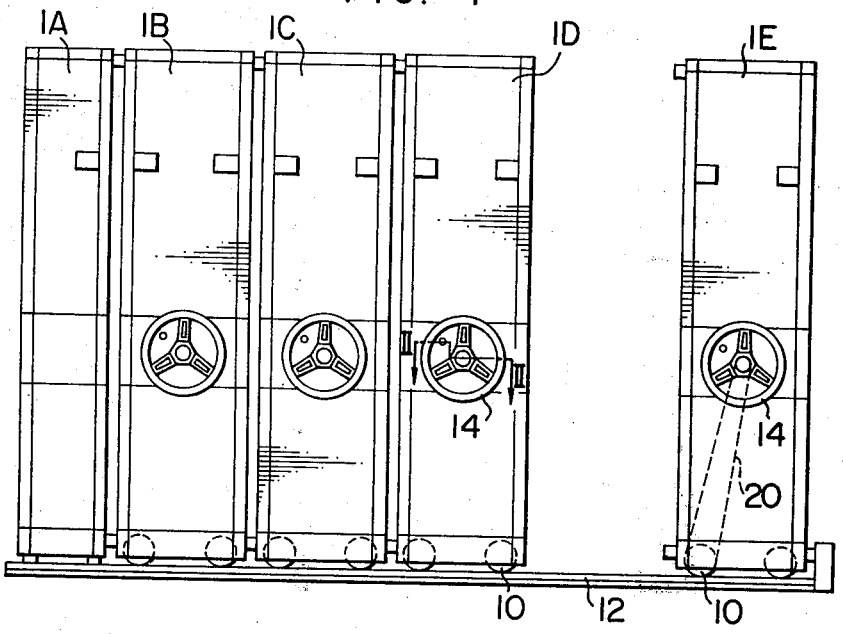
FIG. 1 is a side view of wheeled storage racks or bookshelves in accordance with the present invention arrayed on the rails laid on the floor.
Figure 2:
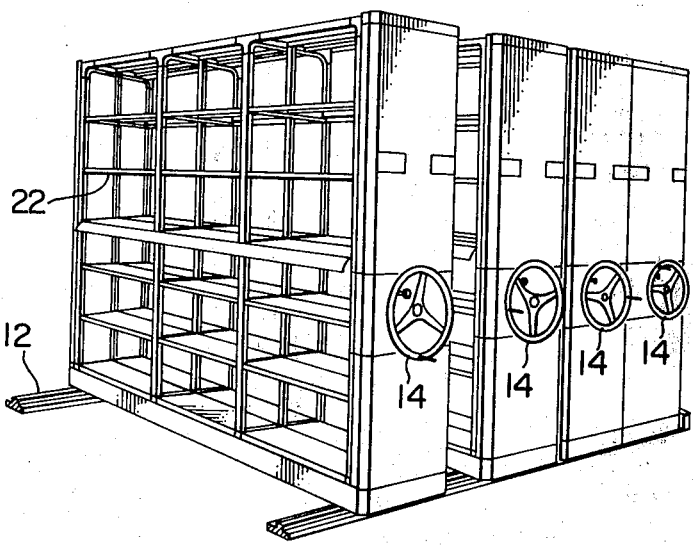
FIG. 2 is a perspective view thereof.
Figure 3:
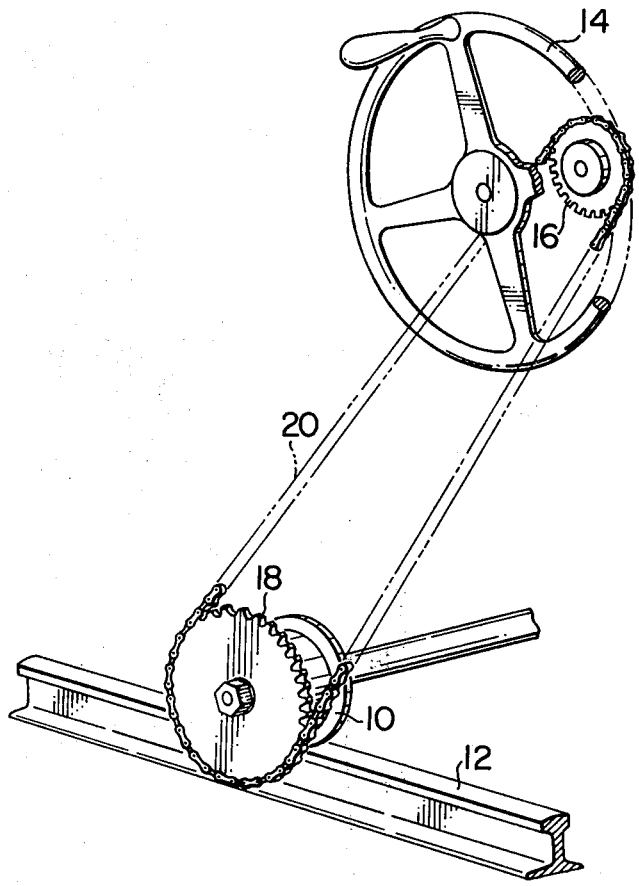
FIG. 3 is a perspective view of a driving mechanism of the storage rack or the like in accordance with the present invention.

First Embodiment, FIGS. 1, 2 and 3

Referring to FIGS. 1 through 3, the first embodiment of the present invention will be described hereinafter. As shown in FIGS. 1 and 2, a plurality of wheeled storage racks or bookshelves (five in the instant embodiment) 1A through 1E ride on rails 12 laid on the floor, and the storage racks or bookshelves 1D and 1E are shown as being spaced apart from each other to provide access to them. An operating handwheel 14 is carried at a suitable height from the floor at the outer end of a shaft extending through one side wall of each storage rack or bookshelf, and a driving sprocket 16 is attached to the inner end of the shaft as best shown in FIG. 3. A driven sprocket 18 the diameter of which is greater than that of the driving sprocket 16, is attached to the axle of the driving wheel 10 outwardly and coaxially thereof, the wheels 10 being attached to the bottom plate of each storage rack or bookshelf. The driving and driven sprockets 16 and 18 are drivingly connected with each other with an endless power transmission chain 20. This endless chain 20 may be replaced with an endless belt, a rope or the like. It is preferable from the standpoint of outer appearance to have the chain drive mechanism (consisting of the driving and driven sprockets 16 and 18 and the endless power transmission chain 20) disposed in the space defined by the double side wall of the storage rack or bookshelf. This arrangement also permits the easier attachment of the shelves to the side wall.

When one manually rotates the handwheel 14, the amplified power is transmitted to the driving wheel 10 through the chain drive mechanism so that even a heavy storage rack or bookshelf may be easily moved along the rails 12. Instead of the train or chain drive mechanism consisting of one pair of sprockets 16 and 18, two pairs of sprockets may be used if so desired. In this case, two intermediate sprockets are coaxially disposed between the sprockets 16 and 18. The reduction ratio may be increased so that the storage rack or bookshelf may be transported with less power.

Figure 4:
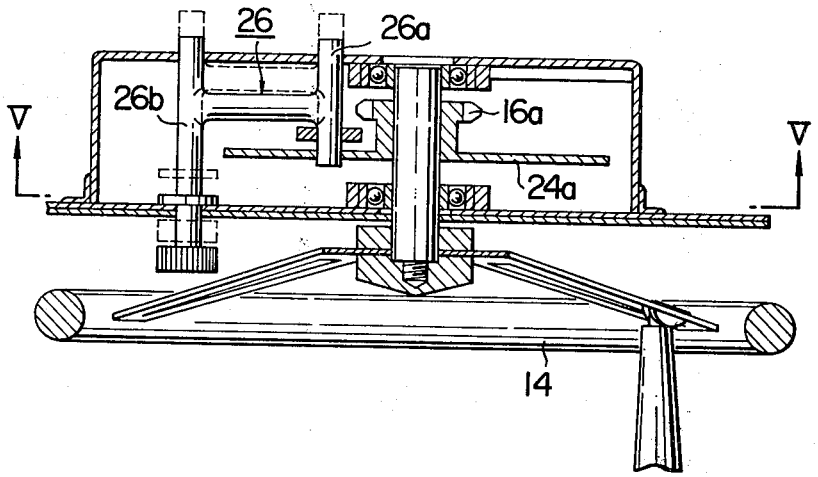
FIG. 4 is a top view of a locking device in accordance with the present invention.
Figure 5:
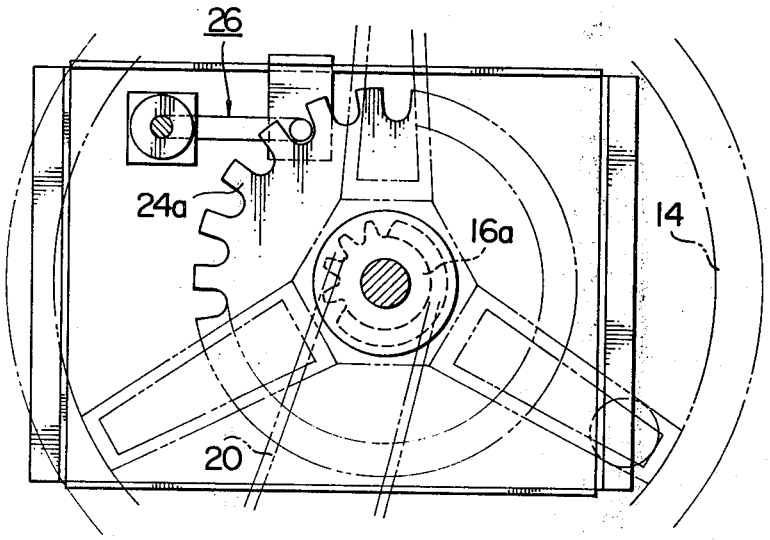
FIG. 5 is a sectional view thereof taken along the line V—V of FIG. 4.

Second Embodiment, FIGS. 4 and 5

Next referring to FIGS. 4 and 5 the second embodiment of the present invention will be described. The second embodiment is substantially similar in construction to the first embodiment except that a locking device is provided in order to hold the storage rack or bookshelf stationary in desired position. That is, when the rails 12 are inclined downward to the right in FIG. 1, the storage racks or bookshelves 1B through 1D would naturally roll down to the right so that an operator would be sandwiched between the storage racks or bookshelves 1D and 1E. In order to prevent such accident, the locking device to be described hereinafter is attached to each of the storage racks or bookshelves 1B through 1D, the leftmost storage rack or bookshelf 1A being held stationary or immovable.

The locking device comprises, in general, a toothed wheel **24*a* carried by the shaft of the handwheel 14 and formed integral and coaxial with the driving sprocket 16*a*, and a detent member 26, H-shaped when viewed from the above as best shown in FIG. 4, consisting of an engaging rod 26*a* and a shaft rod 26*b* firmly connected to and in parallel to each other by a connecting rod. The shaft rod 26*b* is so journalled as to be slidable in the axial direction between the inner and outer walls of the double side wall and has its outer portion extended beyond the outer wall and attached to an operating knob as best shown in FIG. 4**.

In operation, one grips the knob and pulls the detent member 26 outwardly, that is toward him so that the engaging rod **26*a* engages with the teeth of the toothed wheel 24*a*, thereby locking the driving mechanism, that is the handwheel 14 and hence the driving wheel 10. Thus the storage rack of bookshelf may be securely held in stationary position. To release the locking device, one pushes the knob inwardly so that the engaging rod 26*a* may come out of engagement with the toothed wheel 24*a*. Thereafter, one rotates the handwheel 14** to move the storage rack or bookshelf to a desired position.

Figure 6:
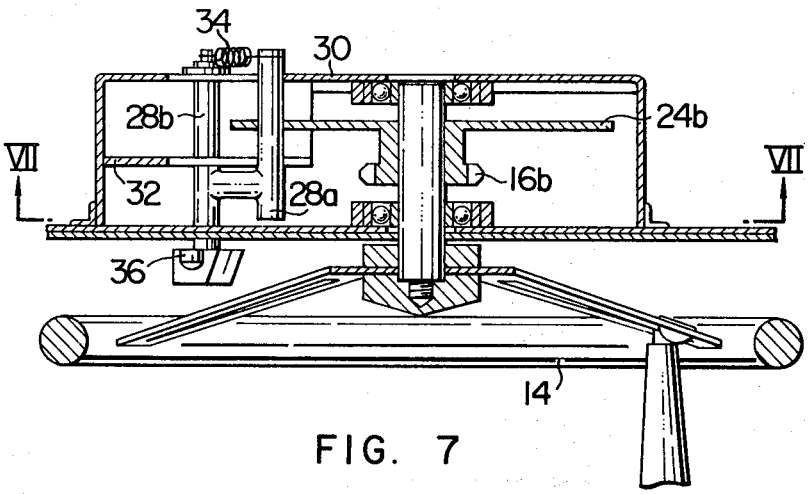
FIG. 6 is a top view of another embodiment of a locking device in accordance with the present invention.
Figure 7:
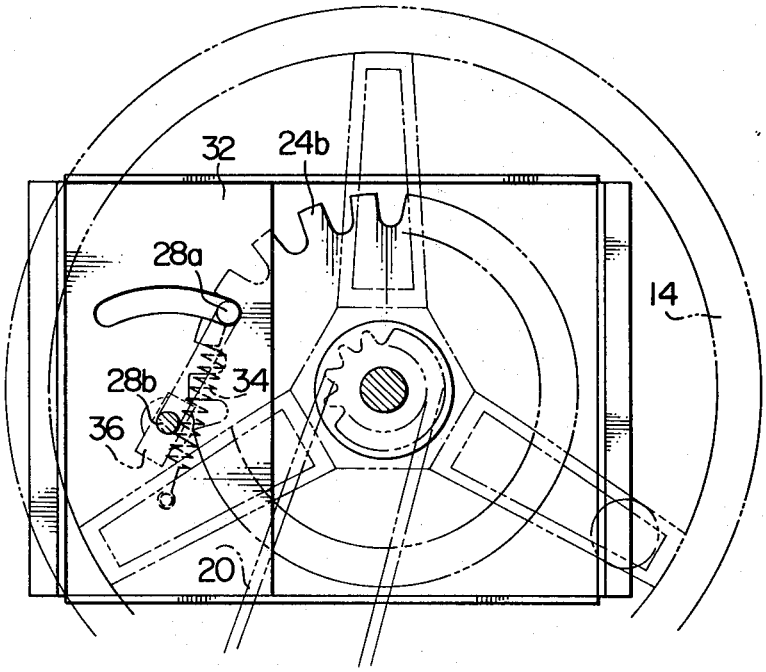
FIG. 7 is a sectional view thereof taken along the line VII—VII of FIG. 6.

Third Embodiment, FIGS. 6 and 7

The third embodiment to be described hereinafter with reference to FIGS. 6 and 7 is substantially similar in construction to the second embodiment (FIGS. 4 and 5) except the arrangement of the H-shaped detent member, which is also substantially similar in construction to the detent member 26 of the second embodiment. That is, the shaft rod **28*b* of the detent member 28 is rotatably journalled between the inner wall 30 and the outer wall of the double side wall through an auxiliary panel or wall 32, and the engaging rod 28*a* extends through coaxial arcuate slots formed in the outer wall 30 and the auxiliary panel 32. An operating knob 36 is attached to the outer end of the shaft rod 28*b* extending out of the side wall, and a tension spring 34 has its one end fixed to a point of the inner wall 30 immediately below the inner end of the shaft rod 28*b* and its the other end to the inner end of the engaging rod 28*a***.

When one grips the operating knob 36 and rotates it in the counterclockwise direction to release the engaging rod **28*a* from the toothed wheel 24*b*, the locking device is released so that he may rotate the handwheel 14 to move the storage rack or bookshelf to any desired position. To lock the handwheel 14 and hence the driving wheel 10, one rotates the operating grip 36 in the clockwise direction to engage the engaging rod 28*a* with the toothed wheel 26*b* as shown in FIG. 7. Thus, the handwheel 14 and hence the wheel 10 are locked so that the storage rack or bookshelf may be securely held stationary in position. As the operating knob 36 is rotated in the clockwise or counterclockwise direction, the tension spring 34 is extended and then passes beyond its change point so that the engaging rod 28*a* may be securely held in the locking position shown in FIG. 7 or in the released position. Even when the engaging rod 28*a* is pressed against the crest of the tooth of the toothed wheel 26*b*, the toothed wheel 26*b* rotates as the storage rack or bookshelf is moved so that the engaging rod 28*a* may be readily forced to fall into the space between the teeth of the toothed wheel 26*b* under the force of the tension spring 24**.

Figure 8:
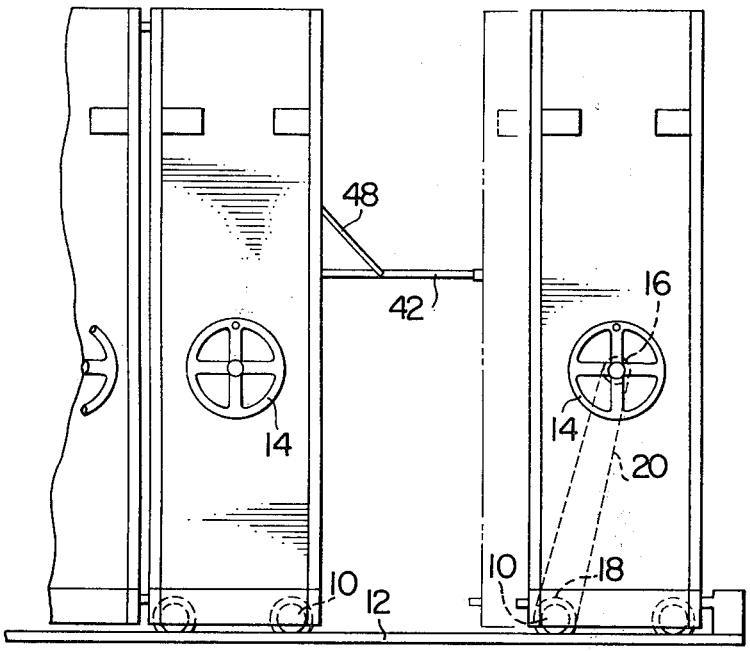
FIG. 8 is a side view of a storage rack or the like incorporating a safety device in accordance with the present invention.
Figure 9:
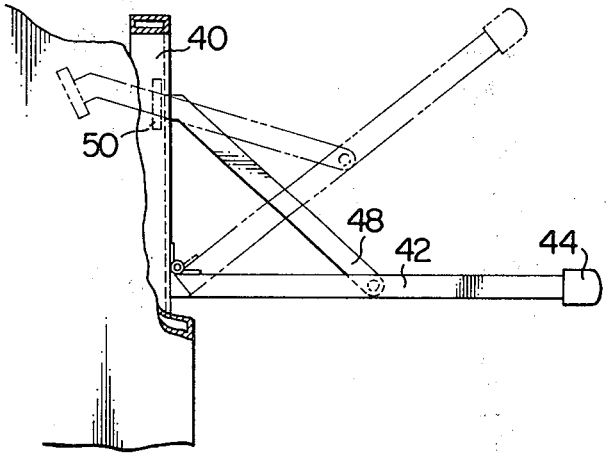
FIG. 9 is a side view, on enlarged scale, of the safety device.
Figure 10:
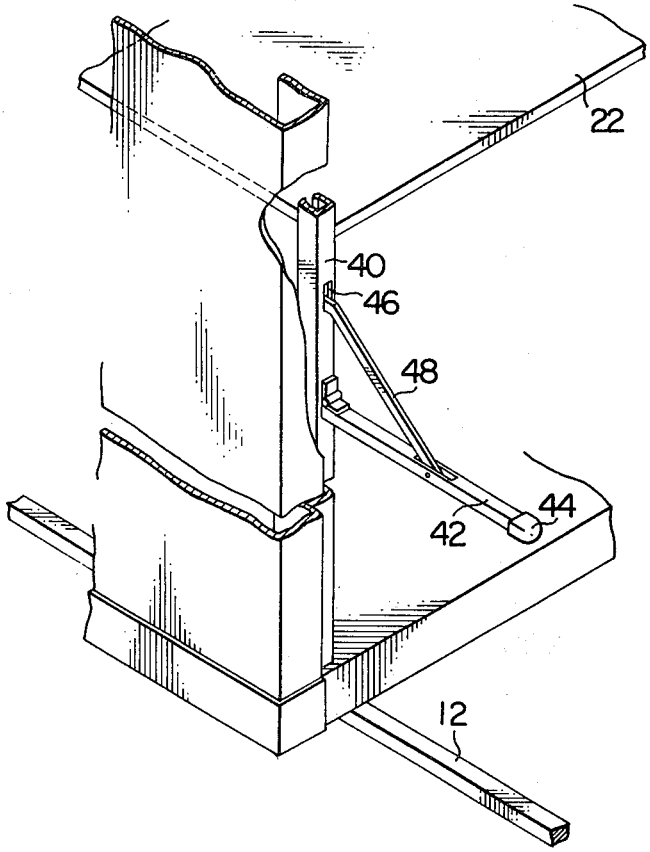
FIG. 10 is a perspective view thereof.

Fourth Embodiment, FIGS. 8, 9 and 10

The fourth embodiment to be described with reference to FIGS. 8, 9 and 10, is characterized by the provision of a safety device for preventing an operator or worker from being sandwiched between the adjacent storage racks or bookshelves by accidental rolling thereof. The safety device comprises, in general, a swingable supporting member 42 whose base is hinged or attached to one column member 40 of the storage rack or bookshelf and whose free end is provided with an impact receiving member 44, and a brace member 48, with one end pivoted to the supporting member 42 at a suitable point and the other end extended through a slot formed in the column member 40 (See FIG. 10) and attached to an engaging member 50.

When one enters into the passage between the adjacent storage racks or bookshelves, he pulls down the supporting member 42 into the horizontal operative position as shown in FIG. 9. Therefore even when one of the adjacent storage racks or bookshelves is accidentally moved by another operator, the supporting member 42 engages with it and prevents its further movement so that the safe space for an operator may be secured between the adjacent storage racks or bookshelves. After one has picked up the desired parts or put the parts upon the shelf or shelves, he comes out of the passage between the adjacent storage racks or bookshelves and folds back the safety device into the retracted position, that is the position where the supporting member 42 is held upright along the column member 40. In the retracted position, the brace member 48 serves as a weight that keeps the supporting member 42 in the retracted position and prevents it from swinging back to the horizontal operative position by an accident. In order to ensure that the safety device may be securely held in the retracted position, any suitable locking device may be provided.

The storage racks or bookshelves in accordance with the present invention may be provided with both of the locking device and the safety device of the types described above or either of them.

It is to be understood that even though the safety device has been described as being attached to the manually operated bookshelf or storage rack, it may be attached to any power-driven or manually-driven storage racks or bookshelves.

Figure 11:
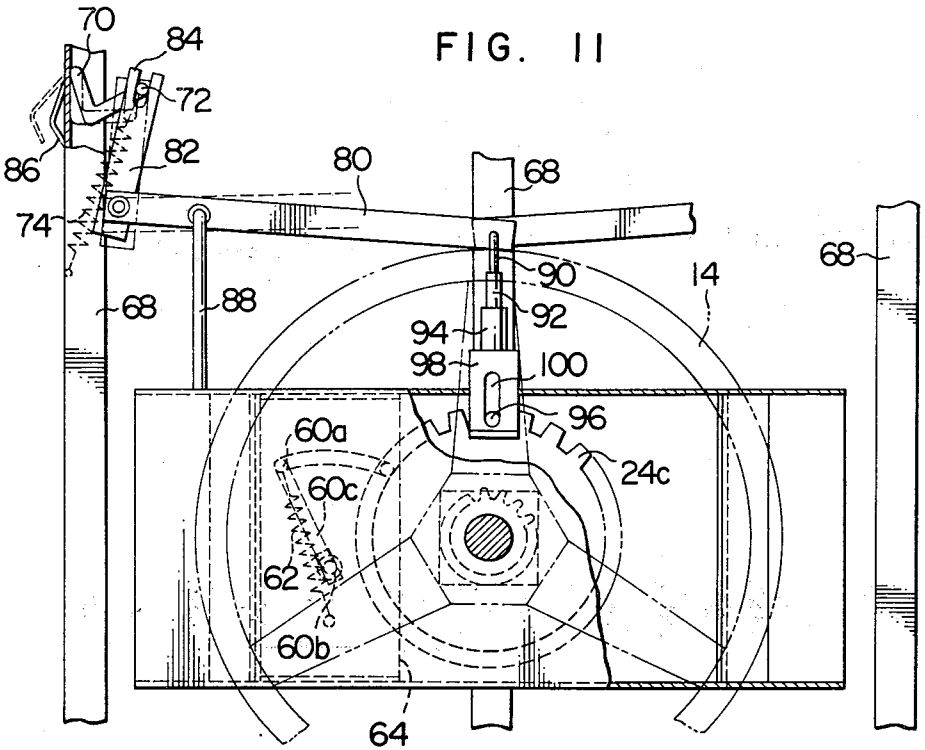
FIG. 11 is a safety locking device in accordance with the present invention.
Figure 12:
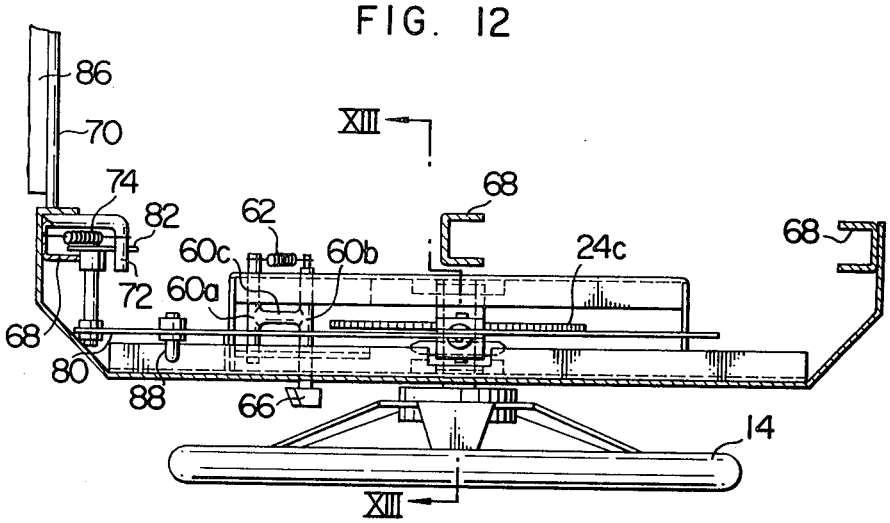
FIG. 12 is a top view thereof.
Figure 13:
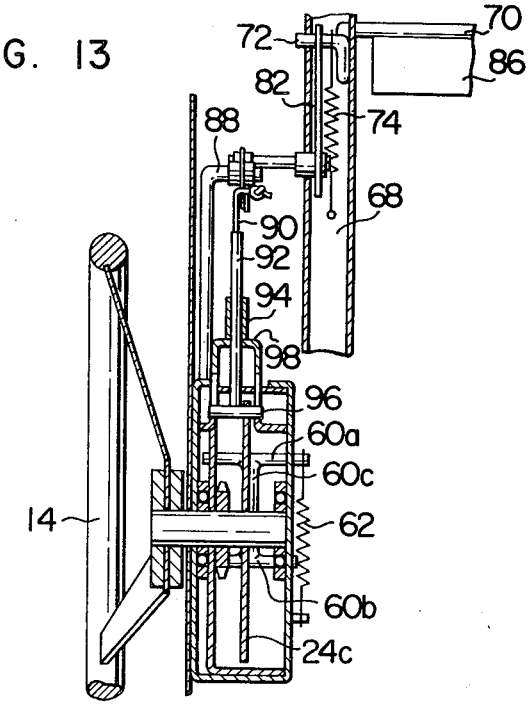
FIG. 13 is a sectional view thereof taken along the line XIII—XIII of FIG. 12.

Fifth Embodiment, FIGS. 11, 12, and 13

The fifth embodiment to be described hereinafter with reference to FIGS. 11, 12, and 13 is substantially similar to the third embodiment (See FIGS. 4 and 5) except that it further comprises safety device operatively coupled to the locking device which is shown in FIGS. 11, 12, and 13 as comprising the toothed wheel 24*c*, the detent member 60 consisting of the engaging rod 60*b*, the shaft rod 60*a* with the operating knob 66 and the connecting rod 60*c*, and the tension spring 62.

A lateral shaft 70 is rotatably journalled between a pair of opposed channel-shaped column members 68 at the corners of the storage rack or bookshelf, and has its one end portion close to the handwheel 14 bent in the form of an L-shaped crank. That is, after extending through one side wall of the channel-shaped column member 68, it is bent at a right angle within the channel-shaped column member 68, and bent again at a right angle to form a crank section 72 extending outwardly through the opening of the channel-shaped member 68 and in parallel with the section of the lateral shaft 70 extending horizontally and transversely across the opening of the storage rack or bookshelf. The crank section 72 is made into engagement with the bifurcated end 84 of a connecting lever 82 which has its other end pivoted to one end of an actuating lever 80.

A buffer plate 86 has its one side firmly joined to the lateral shaft 70 in the lengthwise direction, and a tension spring 74 is loaded between the crank section 72 and the channel-shaped column member 68 so that the buffer plate 86 may be normally held in the extended position indicated by the broken lines in FIG. 11. The angle of rotation of the buffer plate 86 is limited because the angle of rotation of the downwardly extended section of the lateral shaft 70 is limited by the side walls of the channel-shaped column member 68.

The actuating lever 80 is also pivoted to a pivot member 88 at a point close to the end which is pivoted to the connecting lever 82. A rod member 92 is suspended through a flexible member 90 such as chain or string from the other end of the actuating lever 80, extends slidably through a stationary guide member 94, and has its lower end attached to an engaging member 96 at right angles thereto. One end portion of the engaging member 96 extends through a vertical slot 100 formed in the wall of the guide member 98 for engagement with the teeth of the toothed wheel 24*c*.

In the normal or nonoperative position, the crank section 72 of the lateral shaft 70 pushes the connecting lever 82 under the force of the spring 74 so that the actuating lever 80 is rotated in the counterclockwise direction about the pivot member 88. Thus the rod member 92 and hence the engaging member 96 is lifted out of engagement with the toothed wheel 24*c*. The buffer plate 86 is placed between the side walls of the storage rack or bookshelf and at such height from the floor that it may be actuated by an operator or worker when his body touches or bumps against the buffer plate 86.

When the buffer plate 86 is in the normal or inoperative position indicated by the broken lines in FIG. 11, the handwheel 14, that is the driving mechanism, is not locked as described hereinbefore so that the storage rack or bookshelf may be freely moved along the rails 12. When one of the adjacent spaced apart storage racks or bookshelves is moved by an accident when an operator or worker is in the passage or space between them, the buffer plate 86 hits the body of an operator or worker so that it swings to the position indicated by the solid line in FIG. 11. As a result the connecting lever 82 and the actuating lever 80 are displaced to the positions indicated by the solid lines in FIG. 11 so that the engaging member 96 is lowered to make engagement with the toothed wheel 24. Thus the handwheel 14 and hence the driving wheel 10 are locked so that the storage rack or the bookshelf is immediately stopped and held stationary. When the operator or worker leaves from the buffer plate 86, it is returned to its normal or inoperative position under the force of the spring 74.

The reason why the rod member 92 is suspended from the actuating lever 80 through the flexible member 90 is to permit the flexible member 90 to slack when the engaging member 96 engages with the crest of the tooth of the toothed wheel 24*c* so that its downward movement is prevented. When the toothed wheel 24*c* rotates through a very small angle, the engaging member 96 immediately drops into the space between the teeth of the toothed wheel 24*c*. thereby locking the driving mechanism.

Figure 14:
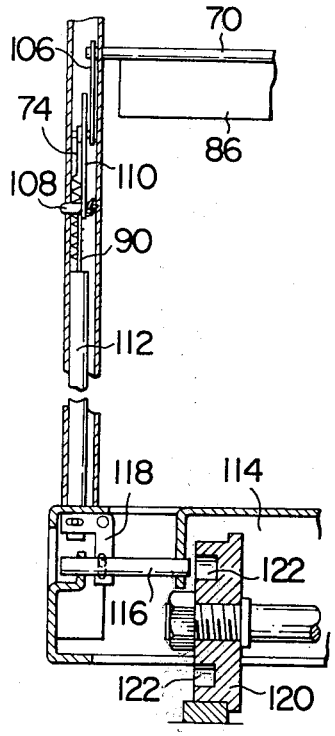
FIG. 14 is a front elevational view in partial section of another embodiment of a safety locking device in accordance with the present invention.
Figure 15:
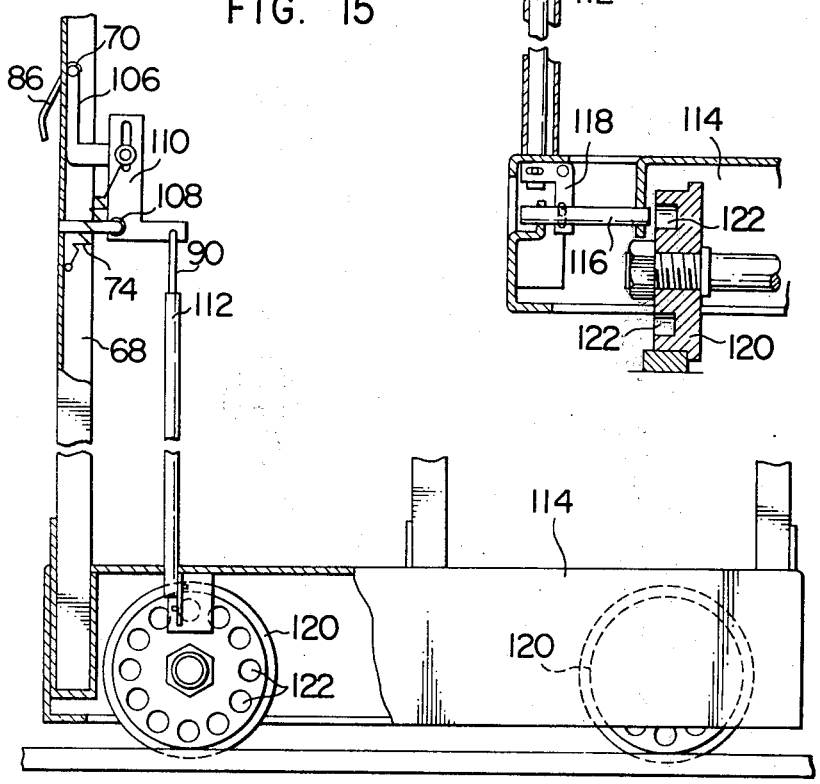
FIG. 15 is a side view thereof.

Sixth Embodiment, FIGS. 14 and 15

In the sixth embodiment, the buffer plate 86 and the lateral shaft 70 are arranged in a manner substantially similar to that described hereinbefore with reference to the fifth embodiment, FIGS. 11–13. An L-shaped crank member 106 has its one end firmly attached to one end of the lateral shaft 70 close to the handwheel 14, and has its other end loosely fitted into an elongated slot formed at one end portion of a bell crank 110 pivoted at 108. A rod member 112 is suspended through the flexible member 90 from the other end of the bell crank 110. The spring 74 is loaded between the inner wall of the channel-shaped column member 68 and the other end of the L-shaped crank member 106 so that the buffer plate 86 may be normally held in the extended position shown in FIG. 15. As a result the rod member 112 is held in the lifted position.

The lower portion of the rod member 112 extends through the top plate of a carriage box or casing 114, and a pin extended from the lower portion of the rod member 112 is loosely fitted into an elongated slot formed in one arm of a second bell crank 118. An engaging member 116 is guided for the horizontal sliding movement by a pair of guide members struck out of the carriage box 114 as best shown in FIG. 14. The engaging memberr 116 has a pin extended laterally and made into engagement with an elongated slot formed in the other arm of the bell crank 118. One end of the engaging member 116 is adapted to engage with one of a plurality of engaging holes 122 formed equiangularly in the outer surface of the wheel 120 along the same circle coaxail therewith.

In normal or inoperative position, the engaging member 116 is retracted to the left and is out of engagement with the engaging hole 112 as shown in FIG. 14 so that the wheel 120 may be free to rotate. However, when the storage rack or bookshelf is accidently moved so that the buffer plate 86 hits or bumps against an operator or worker, the buffer plate 86 is rotated in the counter clockwise direction. The member 106 rotates also in the counterclockwise direction so that the bell crank 110 is caused to rotate in the clockwise direction. The rod member 112 is lowered so that the bell crank 118 is caused to rotate in the counterclockwise direction. The engaging member 116 is caused to advance to the right into engagement with one of the engaging holes 122 of the wheel 120. As a result the wheel 122 is locked so that the storage rack or bookshelf is immediately stopped and held stationary.

Figure 16:
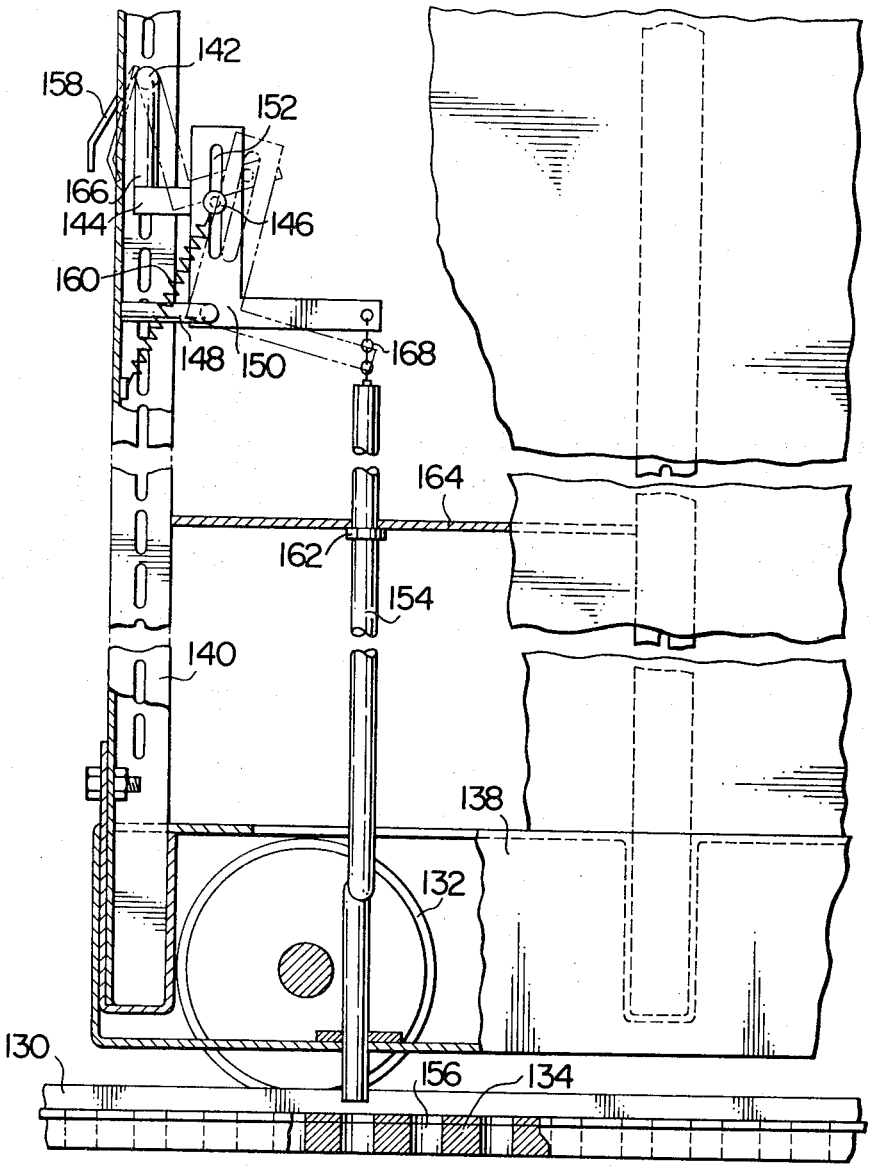
FIG. 16 is a side view, partly broken, of a still another embodiment of a safety locking device in accordance with the present invention.

Seventh Embodiment, FIG. 16

A rail supporting member 134 supporting a rail 130 is provided with a plurality of engaging holes 156 arrayed in the lengthwise direction. An upright channel-shaped column member 140 is attached to one of the corners of the carriage box 138 carrying the wheels 132. A lateral shaft 142 is formed integral with buffer plate 158 and is rotatably journalled by a pair of channel-shaped column members 140 attached to the carriage box 138 at the opposite corners thereof, respectively. One end of the lateral shaft 142 is securely attached to the upper end of a crank member which is disposed within the channel-shaped column member 140 and normally assumes a vertical position. The lower end of the crank member 166 is securely attached to one end of a connecting member 144 which normally assumes a horizontal position. The other end portion of the connecting member 144 is extended out of the channel-shaped column member 144, and a rivet 146 with a head is fixed to the other end of the connecting member 144 at a right angle thereto and is loosely fitted into a guide slot 152 formed in one arm of a bell crank 150 pivoted to a supporting member 148 extended from the channel-shaped column member 140. The lower end of an engaging member 154 which is suspended through a flexible member 168 from the other arm of the bell crank 150 is normally held very closely spaced apart relation with one of the holes 156 of the rail supporting member 134. A tension spring 160 is loaded between the rivet 146 and the channel-shaped column member 140 so that the buffer plate 158 is held in the extended position indicated by the solid lines in FIG. 16. The angle of rotation of the bell crank 150 is limited by the engagement of a collar 162 fitted over the engaging member 154 with a guide plate 164 for the engaging member 154. The buffer plate 158 is extended across the opening of the storage rack or bookshelf at such a height that it may be actuated by an operator or worker when it hits his body.

The mode of operation of the seventh embodiment will be readily understood from the description of the fifth and sixth embodiments so that no further description shall be made in this specification.

It is to be understood that the form of the invention herein shown and described is to be taken as preferred examples of the same and that various changes in the shape, size and arrangement of parts may be resorted to without departing from the spirit of the invention or the scope of the subjoined claims.

What is claimed is:

1. A wheeled storage rack adapted for manual movement and locking, comprising:

a. a pair of rails;

b. a storage rack rollable on said rails and having a plurality of pairs of wheels with each pair having a connecting axle;

c. a handwheel with a shaft rotatably attached to one side wall of said storage rack;

d. a driving sprocket of predetermined diameter coaxially carried by the shaft of said handwheel;

e. a driven sprocket carried by one of said axles and having a diameter larger than said driving sprocket;

f. an endless power transmission chain connected between the driving and driven sprockets; and g. locking means on said storage rack having engagement means and external actuating means positioned for human contact, said engagement means positively locking said storage rack in a fixed position relative to said rails when said actuating means is actuated.

2. A wheeled storage rack of claim 1 in which a manually positioned safety device is mounted on a front of said rack, said safety device comprising a swingable supporting member hindedly connected to the front of said rack and a brace member having one end pivotably connected between the ends of said supporting member, and the other end extending through a slot in the front of the rack, said other end having an engaging member which abuts the slot when said swingable supporting member is deployed.

3. A wheeled storage rack of claim 1 in which said locking means comprises a toothed wheel formed integrally and coaxially with said driving shaft and carried by the shaft thereof, said actuating means being an operator knob on the side of the rack which actuates said engaging means to engage said toothed wheel.

4. A wheeled storage rack of claim 3 in which said engaging means comprises an H-shaped detent member having an engaging member and a shaft member interconnected integrally by a connecting member in parallel with each other and in spaced apart relation, said shaft member being axially slidably supported in an aperture of the side of the storage rack and an inner wall, the end of the shaft member protruding through the aperture having said operator knob thereon, whereby said engaging member engages said toothed wheel when said operator knob is pulled out by an operator.

5. A wheeled storage rack of claim 3 in which said engaging means comprises an H-shaped rotatable detent member comprising an engaging member and a shaft member interconnected integrally by a connecting member in parallel with each other and in spaced apart relation, said shaft member being rotatably supported through an aperture in the side of said rack and by an inner wall, said operator knob being connected to the end of said shaft member protruding through said aperture, said engaging member being biased with a spring to maintain a rotated position of said engaging member.

6. A wheeled storage rack of claim 1 in which said locking means comprises a toothed wheel formed integrally and coaxially with said driving shaft and carried by the shaft thereof, said actuating means being a buffer plate on a front of the storage rack for sensing the presence of persons in front of the rack and said engagement means comprises an engagement member slidably disposed adjacent said toothed wheel.

7. A wheeled storage rack of claim 1 in which one of said wheel pairs has a wheel with engaging holes circularly arranged around a side of the wheel, said actuating means being a buffer plate on a front of the storage rack for sensing the presence of persons in front of the rack, and said engagement means comprises a horizontally slidable engaging member adjacent the side of the wheel.

8. A wheeled storage rack of claim 1 in which one of said pair of rails has a row of engaging holes disposed adjacent and parallel thereto, said actuating means being a buffer plate on a front of the storage rack for sensing the presence of persons in front of the rack, and said engagement means comprises a vertically slidable engagement member protruding through a bottom of said storage rack.

9. A wheeled storage rack adapted for manual movement and locking, comprising:

a. a pair of rails;

b. a storage rack rollable on said rails and having a plurality of pairs of wheels with each pair having a connecting axle;

c. a handwheel with a shaft rotatably attached to one side wall of said storage rack;

d. a driving sprocket of predetermined diameter carried by the shaft of said handwheel coaxially thereof;

e. a driven sprocket carried by one of said axles and having a diameter larger than said driving sprocket;

f. an endless power transmission chain connected between the driving and driven sprockets;

g. a toothed locking wheel formed integrally and coaxially with said driving shaft and attached thereto;

h. an H-shaped detent member formed of parallel engaging and shaft members interconnected by a connecting member, said shaft member being axially supported at either end by apertures in an inner wall bracket and the side wall of the storage rack, the shaft member end through the sidewall aperture being connected to an operator knob said engaging member being movable by said knob to engage said toothed wheel.

* * * * *